US006771915B2

(12) United States Patent
Cais et al.

(10) Patent No.: US 6,771,915 B2
(45) Date of Patent: Aug. 3, 2004

(54) COUPLING ARRANGEMENT INCLUDING OPTICAL PHOTOCONDUCTIVE DRUM AND GROUNDING PLATE

(75) Inventors: Rudolf E. Cais, Goleta, CA (US); Jon P. Zogg, Chesapeake, VA (US); William Himes, Suffolk, VA (US)

(73) Assignee: Mitsubishi Chemical America, Chesapeake, VA (US)

( * ) Notice: Subject to any disclaimer, the term of this patent is extended or adjusted under 35 U.S.C. 154(b) by 0 days.

(21) Appl. No.: 10/322,554

(22) Filed: Dec. 19, 2002

(65) Prior Publication Data

US 2004/0120726 A1 Jun. 24, 2004

(51) Int. Cl.[7] ..... G03G 15/00
(52) U.S. Cl. ..... 399/90; 399/116
(58) Field of Search ..... 399/75, 88, 90, 399/116, 117, 159; 174/51

(56) References Cited

U.S. PATENT DOCUMENTS

| | | | | |
|---|---|---|---|---|
| 4,829,335 A | | 5/1989 | Kanemitsu et al. | |
| 5,023,660 A | | 6/1991 | Ebata et al. | |
| 5,729,792 A | * | 3/1998 | Ikehara | 399/90 |
| 5,903,803 A | | 5/1999 | Kawai et al. | |
| 5,920,753 A | | 7/1999 | Sasaki et al. | |
| 5,926,673 A | | 7/1999 | Foster et al. | |
| 5,930,562 A | | 7/1999 | Noda et al. | |
| 5,937,239 A | | 8/1999 | Watanabe et al. | |
| 5,937,242 A | | 8/1999 | Yokoyama et al. | |
| 6,006,058 A | | 12/1999 | Watanabe et al. | |
| 6,029,032 A | | 2/2000 | Watanabe et al. | |
| 6,035,159 A | | 3/2000 | Azuma et al. | |
| 6,070,028 A | | 5/2000 | Odagawa et al. | |
| 6,115,569 A | | 9/2000 | Akutsu et al. | |
| 6,163,665 A | | 12/2000 | Watanabe et al. | |
| 6,167,219 A | * | 12/2000 | Miyamoto et al. | 399/90 |
| 6,169,866 B1 | | 1/2001 | Watanabe et al. | |
| 6,173,146 B1 | | 1/2001 | Wang et al. | |
| 6,175,706 B1 | | 1/2001 | Watanabe et al. | |
| 6,246,849 B1 | | 6/2001 | Yokoyama et al. | |

FOREIGN PATENT DOCUMENTS

| | | |
|---|---|---|
| EP | 0 735 432 | 10/1996 |
| EP | 0 797 125 | 9/1997 |
| EP | 0 797 126 | 9/1997 |

* cited by examiner

*Primary Examiner*—Hoan Tran
(74) *Attorney, Agent, or Firm*—Oblon, Spivak, McClelland, Maier & Neustadt, P.C.

(57) ABSTRACT

A coupling arrangement with an optical photoconductive drum including a drum interior surface having an electrically resistive coating surrounding and extending along a longitudinal axis. The drum interior surface includes first and second open ends. A flange including a flange interior surface is disposed in the first open end. A flange exterior surface is disposed outside of the first open end. A flange side surface connects the flange interior and exterior surface. A grounding plate is disposed in the first open end and includes an outwardly extending contact that contacts the drum interior surface and removes a portion of the electrically resistive coating to achieve electrical connection with the drum interior surface and to hold the flange.

24 Claims, 2 Drawing Sheets

COUPLING ARRANGEMENT INCLUDING OPTICAL PHOTOCONDUCTIVE DRUM AND GROUNDING PLATE

BACKGROUND OF THE INVENTION

1. Field of the Invention

The present invention relates to coupling arrangement including an optical photoconductive drum and a grounding plate in an electro-photographic machine, and more particularly, to the grounding plate that can remove an electrically resistive coating from an interior of the drum to achieve electrical connection therewith, and/or to the grounding plate and a flange, in combination, that can achieve an interference fit with the drum.

2. Discussion of the Related Art

In a known electro-photographic machine, such as a copier, a laser printer, a facsimile, and the like, a known process cartridge is removably mounted to a known main assembly.

The main assembly includes, among other components, a housing, a control panel disposed within the housing for controlling an image forming process, an electronic control system that is operated by the control panel, a motor that is controlled by the control system, a gear train that is driven by the motor, and electrical contacts for delivering power to the removable process cartridge that is inserted into and retained within grooves or channels formed in opposing side walls of the housing. The main assembly also includes an optical projection system and a central processor that controls a sequence and a timing of the optical projection system during a known image forming operation.

The removable process cartridge includes, among other components, an optical photoconductive drum (OPC drum), and a driving gear for driving one or more components of the process cartridge, such as a charging device, a developing device, a cleaning device, and the like.

During the known image forming operation, the OPC drum undergoes a charging/discharging cycle to create a developer image (i.e., a toner image) on a recording material (e.g., a sheet of paper, a transparent sheet, etc.). Briefly, during the charging cycle, the charging device uniformly charges an exterior surface of the OPC drum. The optical projection system projects image containing information in the form of a laser light to selectively discharge a portion of the exterior surface of the OPC drum, thereby forming a latent image. The developing device applies the developer or toner to the partially charged exterior surface of the OPC drum. The toner is electro-statically attracted to the charged areas of the OPC drum, thereby forming a toner image. The toner image is then transferred from the exterior surface of the OPC drum to the sheet of paper.

In the known electro-photographic machine, the exterior surface of the OPC drum is coated with an electrically resistive coating to improve a quality of the image produced during the image forming process. Examples of known electrically resistive coatings include hard anodization with aluminum oxide ($Al_2O_3$), oxidized surfaces, and the like. The OPC drum is submerged in the electrically resistive coating, such that an interior surface of the OPC drum is coated with the electrically resistive coating as well as the exterior surface.

It is also known that the coated OPC drum must be sufficiently grounded to undergo the required discharging portion of the charging/discharging cycle. In the known grounding or earthing arrangement, a grounding plate is disposed beneath the driving gear and within an interior portion of the OPC drum. The grounding plate includes a plurality of radially extending projections that contact the interior surface of the OPC drum. However, to satisfactorily ground the OPC drum, a portion of the electrically resistive coating must be removed through a separate and/or additional process such that the projections of the grounding plate can achieve electrical connection with the interior surface of the OPC drum. An example of a known process for removal of the electrically resistive coating includes a laser scribing operation. The grounding plate also includes a second plurality of projections that contact an electrically conductive shaft extending through the driving gear. After the grounding plate is aligned and inserted into the OPC drum, the driving gear is secured to the drum by a separate and/or additional securing means, thereby preventing relative movement and/or rotation of the grounding plate to the OPC drum. An example of a known securing means includes an adhesive. By this arrangement, the OPC drum is grounded through the grounding plate and/or the shaft.

However, the conventional grounding arrangement suffers from a number of disadvantages. For example, as stated above, the radially extending projections of the grounding plate must be precisely aligned with the portions of the interior surface of the OPC drum from which the electrically resistive coating has been removed to satisfactorily ground the OPC drum. The requirement for such precise alignment provides an impediment to an automatic assembly of the known process cartridge. Further, the resistive coating must be removed from the interior surface of the OPC drum by a separate and/or additional process. Further, the known process cartridge requires additional securing means between the OPC drum and the driving gear to prevent relative movement and/or rotation therebetween. The use of the adhesive as the securing means requires that care be taken to prevent the relative rotation and/or movement after insertion of the grounding plate and the driving gear into the OPC drum before curing of the adhesive. Such disadvantages increase the manufacturing time and/or cost of the known process cartridge.

SUMMARY OF THE INVENTION

The present invention provides a coupling arrangement with an optical photoconductive drum including a drum exterior surface and a drum interior surface having an electrically resistive coating surrounding and extending along a longitudinal axis. The drum interior surface faces toward the longitudinal axis and the drum exterior surface faces away from the longitudinal axis. The drum interior surface includes first and second open ends. A gear flange including a gear interior surface is disposed in the first open end. A gear exterior surface is disposed outside of the first open end. A gear side surface connects the gear interior and exterior surfaces. A grounding shaft opening extends between the gear interior and exterior surfaces. A grounding plate is disposed in the first open end and includes an outwardly extending contact that contacts the drum interior surface and removes a portion of the electrically resistive coating to achieve electrical connection with the drum interior surface and to hold the flange.

The present invention provides a method of grounding an optical photoconductive drum including a drum exterior surface and a drum interior surface having an electrically resistive coating surrounding and extending along a longitudinal axis, the drum interior surface including first and second open ends. A portion of the electrically resistive coating is removed with a first protrusion of a grounding plate to electrically connect the drum interior surface and the grounding plate. A grounding shaft is contacted with a second protrusion of the grounding plate to electrically connect the grounding shaft and the grounding plate.

The present invention provides a method of assembling a drum assembly with an optical photoconductive drum including a drum exterior surface and a drum interior surface having an electrically resistive coating surrounding and extending along a longitudinal axis, the drum interior surface defining first and second open ends. A gear flange is inserted in the first open end. A grounding plate including a first and a second protrusion is inserted in the first open end, the first protrusion achieving an interference fit with the drum interior surface. A grounding shaft is inserted into an opening in the gear flange, the grounding shaft achieving an interference fit with the second protrusion of the grounding plate.

BRIEF DESCRIPTION OF THE DRAWINGS

A more complete appreciation of the present invention, and many of the attendant advantages thereof, will be readily ascertained and/or obtained as the same becomes better understood by reference to the following detailed description when considered in connection with the accompanying drawings, wherein.

DETAILED DESCRIPTION OF THE PREFERRED EMBODIMENTS

Figure 1:
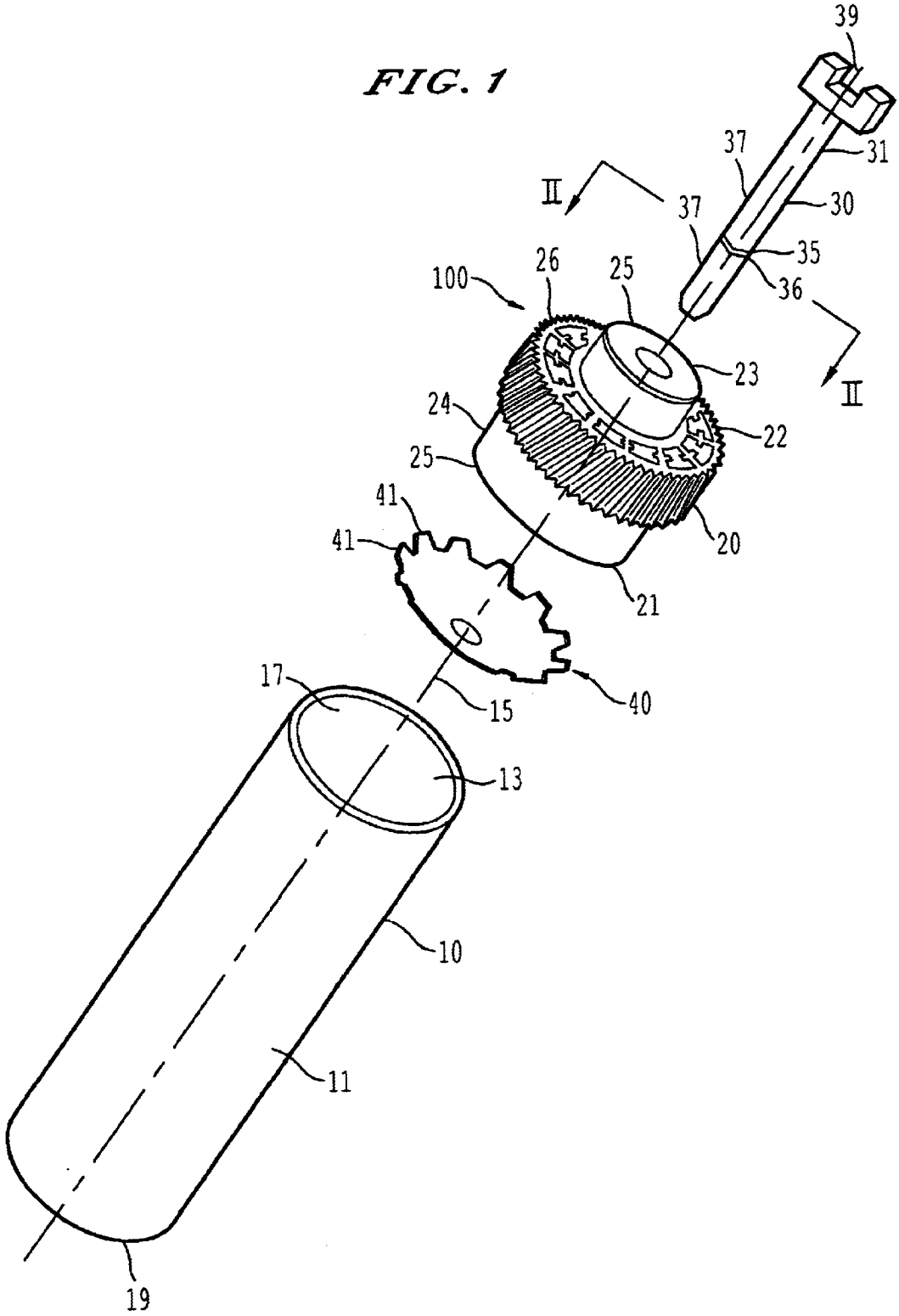
FIG. 1 shows an exploded isometric view of a coupling arrangement including an optical photoconductive (OPC) drum and a grounding plate according to the present invention.
Figure 2:
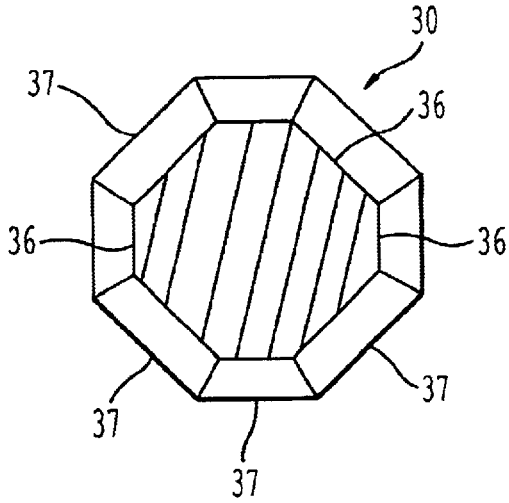
FIG. 2 shows a cross sectional view of a grounding shaft taken along axis II—II of FIG. 1.

Examples of preferred embodiments of the present invention will now be described with reference to the drawings, wherein like reference numbers throughout the several views identify like and/or similar elements.

The figures show an example of a coupling arrangement that can include an optical photoconductive (OPC) drum and a grounding plate of a process cartridge removably mounted to a main assembly of an electro-photographic (EP) machine.

In certain preferred embodiments of the present invention, the grounding plate can remove an electrically resistive coating from a portion of an interior of the OPC drum to achieve electrical connection therewith. A grounding shaft can achieve electrical connection with the grounding plate. By this arrangement, the OPC drum can be grounded with the grounding plate and the grounding shaft.

In certain preferred embodiments of the present invention, the grounding plate can achieve an interference fit with the drum. It is to be understood that the term "interference fit" can include a fit achieved by one or more of contact, friction, and/or plastic or elastic deformation between or among components. The grounding shaft can be inserted into an opening in a gear flange and can achieve an interference fit with the grounding plate. By this arrangement, the grounding plate, the grounding shaft, and the gear flange can be secured and prevented from rotation and/or movement relative to the OPC drum, and can be secured without the use of additional securing means.

As shown in the figures, the coupling arrangement 100 according to the present invention can include, among other components, an optical photoconductive (OPC) drum 10, a flange 20, a grounding shaft 30, and a grounding plate 40, as discussed in detail below.

An electro-static latent image and a subsequent developer image (i.e., a toner image) can be formed on the OPC drum 10 for transfer to a recording material (e.g., a sheet of paper, a transparent sheet, etc.) in a known manner during an image forming process. Thus, although certain preferred embodiments are shown in the drawings, it is to be understood that the OPC drum 10 can be of any type, including of a known type.

As shown in the figures, the OPC drum 10 can include a drum exterior surface 11 and a drum interior surface 13, both of which can extend about along, and about coaxial with, a longitudinal axis 15. The exterior surface 11 can face away from the longitudinal axis 15, and the drum interior surface 13 can face toward the longitudinal axis 15. By this arrangement, the exterior and interior surfaces 11, 13, define the OPC drum 10, such that the OPC drum 10 can be about cylindrical in shape. The interior surface 13 can define first and second open ends 17 and 19, respectively.

The exterior and/or interior surfaces 11, 13, can include an electrically resistive coating, such as a hard anodization with aluminum oxide ($Al_3O_3$), which impedes electrical connection with the respective coated surfaces. The coating can be formed on the exterior surface 11 to improve a quality of the image formed thereon in the image forming process, and the electrically resistive coating can be formed on the interior surface 13 as a consequence of the formation of the coating on the exterior surface 11 (e.g., by submerging the OPC drum 10 into the coating during a known coating process). The electrically resistive coating can be sufficiently electrically resistive so as to impede a discharging portion of a charging/discharging cycle of the OPC drum 10, such that removal of a portion of the electrically resistive coating from the interior surface 13 can improve electrical connection therebetween and can achieve the image formed in the image forming process.

The OPC drum 10 can be of any material that can be used in the formation of the latent image and in the formation of the developer image, such as aluminum.

The flange 20 can be a gear flange that can be used to drive components of the process cartridge and/or the EP machine in a known manner during the image forming process. Thus, although certain preferred embodiments are shown in the drawings, it is to be understood that the gear flange 20 can be of any type, including of a known type.

As shown in the drawings, the gear flange 20 can include a gear interior surface 21 that can be disposed within one of the first and second open ends 17, 19, of the OPC drum 10, and a gear exterior surface 22 that can be disposed opposite to the gear interior surface 21 and outside of the first or second open end 17, 19, in which the gear interior surface 21 can be disposed. The gear interior and exterior surfaces 21, 22, can be about parallel to one another and can be about perpendicular to a longitudinal axis 23 of the gear flange 20, and the longitudinal axis 23 can be about perpendicular to the longitudinal axis 15 when the gear flange 20 is inserted into the OPC drum 10.

The gear interior surface 21 can also include one or more alignment posts (not shown) corresponding to one or more alignment voids in the grounding plate 40 (discussed in detail below) to aid in assembly of the coupling arrangement 100, and more particularly to aid in the insertion of the grounding plate 40 with the gear flange 20 into the OPC drum 10 in a known manner. The alignment posts (and the corresponding alignment voids) can be of a known type having an "x" or cross-shaped cross-section. Preferably, the gear interior surface 21 can include a plurality of alignment posts, and more preferably can include at least four (4) alignment posts that correspond to at least four (4) alignment voids in the grounding plate 40.

A gear side surface 24 can extend between the interior and exterior surfaces 21, 22, which is about perpendicular to the longitudinal axis 23. The gear side surface 24 can include a first profile 25 disposed adjacent to the exterior surface 22 and a second profile 26 disposed adjacent to the interior surface 21. The first profile 25 can include one or more driving teeth for driving the components of the process cartridge and/or the components of the EP machine. The second profile 26 can be disposed within the OPC drum 10, and can be sized to achieve an interference fit with the interior surface 13 of the OPC drum 10. As shown in the drawings, the first profile 25 can have a maximum diameter that is equal to or greater than a maximum diameter of the second profile 26, such that the gear side surface 24 can have a stepped profile. By this arrangement, when the gear interior surface 21 is inserted into the OPC drum 10, a step of the gear side surface 24 can abut an end of the OPC drum 10, such that complete insertion can be achieved.

The gear flange 20 can include a grounding shaft opening 25 that extends between the gear interior surface 21 and the gear exterior surface 22 to communicate an interior and an exterior of the OPC drum 10. The grounding shaft opening 25 can be sized to achieve an interference fit with one or more surfaces of the grounding shaft 30 (discussed in detail below). The grounding shaft opening 25 can be about concentric with and can be about perpendicular to the longitudinal axis 23 of the gear flange.

In certain preferred embodiments of the present invention, the grounding shaft 30 can achieve electrical connection with the grounding plate 40 (discussed in detail below) thereby grounding the grounding plate 40 and the OPC drum 10 during the discharge portion of the charge/discharge cycle of the image forming process. The grounding shaft 30 can be inserted into the grounding shaft opening 25 of the gear flange 20 and can achieve an interference fit with the grounding plate 40 (discussed in detail below), thereby securing the grounding plate 40 and the gear flange 20 with the OPC drum 10.

The gear flange 20 can be of any material that can be used to drive the components of the process cartridge and/or the EP machine during the image forming process, such as an engineering plastic resin that can include at least one of a thermoplastic and/or a thermoset. Examples of such plastics can include polyacetals, nylons, and/or polyesters.

As shown in the drawings, the grounding shaft 30 can include a first end 31 and a second end 35 extending about along an axis 39. Either or both of the first and second ends 31, 35, can include one or more faces, such that the first and second ends 31, 35, can have a polygonal cross-section. In certain preferred embodiments of the present invention, each of the first and second ends 31, 35, can include four (4) or more faces, and, more preferable, can include at least eight (8) faces, such that each of the first and second ends 31, 35, have an octagonal cross-section.

As shown in the drawings, the first end 31 can include a driving engagement for driving the OPC drum 10 during the image forming process. The driving engagement can be sized, shaped, oriented, and/or otherwise disposed such that the grounding shaft 30 can he driven during the image forming process. The second end 35 can include a contact portion 36 and adjacent portions 37 that are adjacent to the contact portion 36. The contact portion 36 can contact a portion of the ground plate 40 (discussed in detail below) to achieve electrical connection therewith. The contact portion 36 can have a maximum diameter that is less than a maximum diameter of one or both of the adjacent portions 37. The contact portion 36 can include one or more scalloped or recessed portions. Further, the one or more recessed portions can each be in the form of a U-shaped portion. In certain preferred embodiments of the present invention, each of the polygonally disposed faces of the second end 35 can include a U-shaped recessed portion, such that the contact portion 36 includes eight (8) faces each having a U-shaped recessed portion.

In certain preferred embodiments of the present invention, the grounding plate 40 can remove the electrically resistive coating from the interior surface 13 of the OPC drum 10 to achieve electrical connection therewith, and the grounding plate 40 can achieve electrical connection with the grounding shaft 30. By this arrangement, the OPC drum 10 is grounded through the grounding plate 40 and the grounding shaft 30. In certain preferred embodiments of the present invention, the grounding plate 40 can achieve an interference fit with the OPC drum 10, and the grounding plate 40 can achieve an interference fit with the grounding shaft 30 that is inserted through the grounding shaft opening 25 of the gear flange 20. By this arrangement, the grounding plate 40, the grounding shaft 30, and the gear flange 20 can be secured and prevented from rotation and/or movement relative to the OPC drum 10, and can be secured therewith without the use of additional securing means, such as an adhesive.

Specifically, as shown in the drawings, the grounding plate 40 can include one or more outwardly extending contacts 41 for achieving electrical connection and/or an interference fit with the OPC drum 10, as well as one or more inwardly extending contacts 42 for achieving electrical connection and/or an interference fit with the grounding shaft 30, extending from a center portion 43.

The outwardly extending contacts 41 can be sized, shaped, and/or oriented, and the number of the contacts 41 can be chosen, such that a portion of the electrically resistive coating can be removed from the interior surface 13 of the OPC drum 10. Thus, upon insertion of the grounding plate 40 into the first or second end 17, 19, of the OPC drum 10, with or without the gear flange 20, the grounding plate 40 can achieve electrical connection with the OPC drum 10. Further, the electrical connection can be achieved without an additional and/or separate manufacturing process or step.

Similarly, attributes of the outwardly extending contacts 41 can be chosen such that an interference fit is achieved between the grounding plate 40 and the interior surface 13 of the OPC drum 10. The attributes of the contacts 41 can be chosen, in conjunction with one or more properties of the OPC drum 10, such that an image formed with the OPC drum 10 is not unsatisfactorily degraded. For example, the attributes of the contacts 41 can be chosen such that circularity of the exterior surface 11 of the OPC drum 10 is not changed to adversely affect the quality of the image formed in the image forming process.

As shown in the drawings, the outwardly extending contacts 41 can be separated from one another by recesses 44. Applicants have discovered that satisfactory electrical connection and/or a satisfactory interference fit between the grounding plate 40 and the OPC drum 10 can be achieved by optimizing a distance between the outwardly extending contacts 41. The satisfactory electrical connection and the satisfactory interference fit can be achieved when a total of the maximum arc lengths R between the outwardly extending contacts 41 is greater than a total of the maximum arc lengths C of the outwardly extending contacts 41.

As discussed above, the inwardly extending contacts 42 can contact the contact portion 36 of the grounding shaft 30 inserted through the grounding shaft opening 25 of the gear flange 20. Similar to the contacts 41, one or more attributes of the contacts 42 can be chosen such that electrical connection is achieved between the grounding plate 40 and the grounding shaft 30. Thus, by this arrangement, grounding of the OPC drum 10 (i.e., grounding of the grounding plate 40 with the OPC drum 10, and grounding of the thus-grounded grounding plate 40 with the grounding shaft 30) can be achieved.

Further, one or more of the attributes of the contacts 42 can be chosen such that an interference fit is achieved between the grounding plate 40 and the grounding shaft 30. Thus, by this arrangement, the grounding plate 40, the grounding shaft 30, and the gear flange 20 (e.g., attachment of the grounding plate 40 to the OPC drum 10 by an interference fit, and attachment of the thus-attached grounding plate 40 to the gear flange 20 by the grounding shaft 30) can be achieved.

Specifically, in certain preferred embodiments of the present invention, the inwardly extending contacts 42 can achieve an interference fit with the contact portion 36 of the grounding shaft 30. In a preferred embodiment of the invention, the contacts 42 can be each disposed within a corresponding recessed portions of the contact portion 36 of the grounding shaft 30, and in a more preferred embodiment, eight (8) contacts 42 can be disposed within eight (8) U-shaped recessed portions formed in the faces of the grounding shaft 30.

As shown in the drawings, in certain preferred embodiments of the invention, the grounding plate 40 can include a plurality (i.e., two (2) or more) of outwardly extending contacts 41, and more preferably can include eight (8) or more contacts 41, and still more preferably can include twelve (12) or more contacts 41. The grounding plate 40 can include a plurality (i.e., two (2) or more) of inwardly extending contacts 42, and more preferably can include four (4) or more contacts 42, and still more preferably can include (8) or more contacts 42, each of the contacts 42 corresponding to a face of the contact portion 36 of the grounding shaft 30. Preferably, the outwardly and inwardly extending contacts 41, 42, are radially offset from one another.

The grounding plate 40 can also include one or more alignment voids 47 corresponding to the one or more alignment posts of the gear flange 20 to aid in assembly of the coupling arrangement 100. Preferably, the center portion 43 of the grounding plate 40 can include a plurality of alignment voids 47 having an "x" or cross-shaped cross-section that corresponds to the cross-section of the alignment posts of the gear flange 20, and more preferably includes at least four (4) alignment voids 47 that correspond to the at least four (4) alignment posts.

Figure 3A:
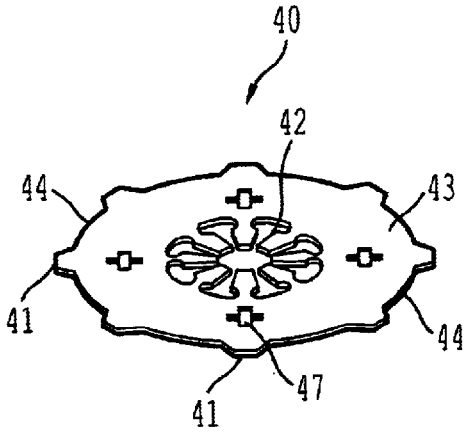
FIGS. 3A–3C show cross sectional views of the grounding plate in the form of a flat plate, a dome-shaped plate, and a conical plate, respectively, of the present invention.
Figure 3B:
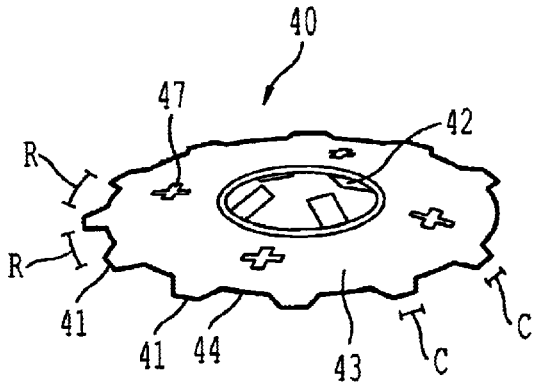
Figure 3C:
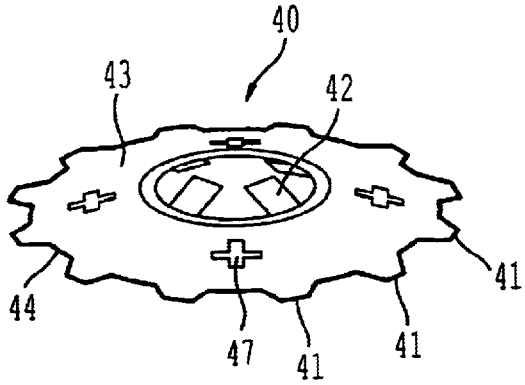

As shown in FIGS. 3A–3C, the grounding plate 40 can have any of a variety of cross-sections that aid in the removal the electrically resistive coating from the interior surface 13 of the OPC drum 10 and/or achieve electrical connection therewith, that achieve an interference fit with the interior surface 13 of the OPC drum 10, that achieve electrical connection with the grounding shaft 30, and/or that achieve an interference fit with the grounding shaft 30. The grounding plate 40 can also include a variety of materials that can achieve one or more of these results. Examples of such materials can include a metal or a metal coating such as copper, iron, and/or aluminum. In a preferred embodiment of the present invention, the grounding plate 40 can include at least one of the metal and/or the metal coating.

Specifically, the grounding plate 40 can include a convex surface opposite to the gear flange 20, such that upon insertion of the grounding plate 40, with or without the gear flange 20, into the OPC drum 10, and upon insertion of the grounding shaft 30 into the grounding shaft void 25 of the gear flange 20, the grounding plate 40 can achieve the desired electrical connections and/or interference fits. It is to be understood that during the insertion, the grounding plate 40 can become more convex, such that the insertion of the grounding plate 40 and/or other components of the coupling arrangement 100 into the interior of the OPC drum 10 can be facilitated. The convex shape can become at least slightly less convex (i.e., can become at least slightly more flat) to achieve better electrical connections and/or interference fits upon the cessation of the insertion. Thus, it is be understood that an application of a force that is opposite to the direction of the insertion of the grounding plate 40 into the interior of the OPC drum 10 can flatten the grounding plate 40, such that removal of the grounding plate 40 and/or other components of the coupling arrangement 100 from the OPC drum 10 can be impeded.

The above-disclosed apparatus can provide a method of grounding an optical photoconductive drum including a drum exterior surface and a drum interior surface having an electrically resistive coating surrounding and extending along a longitudinal axis, the drum interior surface defining first and second open ends. A portion of the electrically resistive coating can be removed with a first protrusion of a grounding plate to electrically connect the drum interior surface and the grounding plate. A grounding shaft can be contacted with a second protrusion of the grounding plate to electrically connect the grounding shaft and the grounding plate. The grounding plate can be inserted into the first open end of the drum. A gear flange can be inserted into the first open end of the drum. The grounding shaft can also be inserted though an opening in the gear flange.

The above disclosed apparatus can provide a method of assembling a drum assembly with an optical photoconductive drum including a drum exterior surface and a drum interior surface having an electrically resistive coating surrounding and extending along a longitudinal axis, the drum interior surface defining first and second open ends. A gear flange can be inserted in the first open end. A grounding plate including a first and a second protrusion can be inserted in the first open end, the first protrusion achieving an interference fit with the drum interior surface. A grounding shaft can be inserted into an opening in the gear flange, the grounding shaft achieving an interference fit with the second protrusion of the grounding plate. The interference fit between the first protrusion and the drum and the interference fit between the second protrusion and the grounding shaft can be sufficient to prevent rotation of the drum relative to the gear flange during normal operation of the drum assembly. The relative rotation of the drum can be prevented without using additional securing means between the drum and the gear flange.

Numerous additional modifications and variations of the present invention are possible in light of the above teachings. For example, it is to be understood that the above-described teachings can be applied to any connection between an interior surface of a closed volume and a plate disposed within the interior of the closed volume. It is therefore to be understood that within the scope of the appended claims, the present invention may be practiced otherwise than as specifically described herein.

What is claimed is:

1. A coupling arrangement, comprising:

an optical photoconductive drum including a drum exterior surface and a drum interior surface having an electrically resistive coating surrounding and extending along a longitudinal axis, the drum interior surface facing toward the longitudinal axis and the drum exterior surface facing away from the longitudinal axis, the drum interior surface including first and second open ends;

a flange including a flange interior surface disposed in the first open end, a flange exterior surface disposed outside of the first open end, a flange side surface connecting the flange interior and exterior surfaces, and a grounding shaft opening extending from the flange interior and exterior surfaces; and a grounding plate disposed in the first open end and including an outwardly extending contact contacting the drum interior surface and removing a portion of the electrically resistive coating to achieve electrical connection with the drum interior surface and to hold the flange.

2. The coupling arrangement according to claim 1, further comprising:

a grounding shaft disposed in the grounding shaft opening.

3. The coupling arrangement according to claim 2, wherein the grounding plate further comprises an inwardly extending contact contacting the grounding shaft to achieve electrical connection therewith.

4. The coupling arrangement according to claim 3, wherein the grounding plate includes a plurality of outwardly extending contacts and a plurality of inwardly extending contacts.

5. The coupling arrangement according to claim 4, wherein the outwardly and inwardly extending contacts extend radially from a center portion of the grounding plate.

6. The coupling arrangement according to claim 5, wherein the outwardly extending contacts are radially offset from the inwardly extending contacts.

7. The coupling arrangement according to claim 6, wherein the outwardly extending contacts are separated from one another by recesses, a maximum total arc length of the recesses being greater than a maximum total arc length of the outwardly extending contacts.

8. The coupling arrangement according to claim 3, wherein the grounding shaft includes an electrical contact portion contacting the inwardly extending contact to achieve the electrical connection.

9. The coupling arrangement according to claim 8, wherein the electrical contact portion of the grounding shaft has a maximum diameter that is less than a maximum diameter of an adjacent portion of the grounding shaft.

10. The coupling arrangement according to claim 9, wherein the electrical contact portion comprises a recessed portion.

11. The coupling arrangement according to claim 10, wherein the grounding shaft includes an exterior surface having a plurality of faces defining a polygonal cross section, at least one of the faces including the recessed portion.

12. The coupling arrangement according to claim 11, wherein the recessed portion comprises a U-shaped portion.

13. The coupling arrangement according to claim 11, wherein each of the plurality of faces includes a recessed portion.

14. The coupling arrangement according to claim 13, wherein the plurality of faces comprises eight faces.

15. The coupling arrangement according to claim 14, wherein each of the recessed portions comprises a U-shaped portion.

16. The coupling assembly according to claim 15, wherein the flange includes an alignment post, and the grounding plate includes an aligning void corresponding to the aligning post, the aligning post and void co-operating to retain the grounding plate on the flange.

17. The coupling arrangement according to claim 16, wherein the flange includes four aligning posts, and the grounding plate includes four aligning voids corresponding to the aligning posts.

18. The coupling arrangement according to claim 17, wherein the flange comprises a gear flange configured to drive the coupling arrangement.

19. A method of grounding an optical photoconductive drum including a drum exterior surface and a drum interior surface having an electrically resistive coating surrounding and extending along a longitudinal axis, the drum interior surface defining first and second open ends, comprising:

removing a portion of the electrically resistive coating with a first protrusion of a grounding plate to electrically connect the drum interior surface and the grounding plate; and contacting a grounding shaft with a second protrusion of the grounding plate to electrically connect the grounding shaft and the grounding plate.

20. The method according to claim 19, further comprising:

inserting the grounding plate into the first open end of the drum.

21. The method according to claim 20, further comprising:

inserting a gear flange into the first open end of the drum; and inserting the grounding shaft though an opening in the gear flange.

22. A method of assembling drum assembly with an optical photoconductive drum including a drum exterior surface and a drum interior surface having an electrically resistive coating surrounding and extending along a longitudinal axis, the drum interior surface defining first and second open ends, comprising:

inserting a gear flange in the first open end;

inserting a grounding plate including a first and a second protrusion in the first open end, the first protrusion achieving an interference fit with the drum interior surface; and inserting a grounding shaft into an opening in the gear flange, the grounding shaft achieving an interference fit with the second protrusion of the grounding plate.

23. The method according to claim 22, wherein the interference fit between the first protrusion and the drum and the interference fit between the second protrusion and the grounding shaft are sufficient to prevent rotation of the drum relative to the gear flange during normal operation of the drum assembly.

24. The method according to claim 23, wherein the relative rotation of the drum and is prevented without using additional securing means between the drum and the gear flange.

* * * * *